United States Patent [19]

Graham

[11] 4,356,801

[45] Nov. 2, 1982

[54] THROTTLE BODY FUEL INJECTION

[75] Inventor: Kenneth A. Graham, Birmingham, Mich.

[73] Assignee: Chrysler Corporation, Highland Park, Mich.

[21] Appl. No.: 230,228

[22] Filed: Feb. 2, 1981

[51] Int. Cl.[3] ..... F02M 9/08

[52] U.S. Cl. ..... 123/337; 261/DIG. 78; 261/DIG. 82

[58] Field of Search ..... 123/337, 336, 328; 261/65, DIG. 78, DIG. 82

[56] References Cited

U.S. PATENT DOCUMENTS 3,214,150 10/1965 Rice ..... 261/65 X
3,437,320 4/1969 Walker et al. ..... 261/65 X
3,785,628 1/1974 Lang ..... 261/65
4,186,708 2/1980 Bowler ..... 261/DIG. 78

*Primary Examiner*—William A. Cuchlinski, Jr.
*Attorney, Agent, or Firm*—Newtson & Dundas

[57] ABSTRACT

A throttle body fuel injection system comprises a fuel injector which sprays fuel into an induction bore of circular cross section for mixture with induction air passing through the bore. Fuel is injected exclusively upstream of the throttle blade and apertures are provided which, when the engine is idling with the blade occupying an idle position cracked open from its closed blade position, establish communication between points upstream and downstream of the throttle blade with the apertures being of sufficient size to conduct both the induction air and the entrained fuel as a mixture, allowing sonic velocities for best fuel atomization at engine idle.

2 Claims, 6 Drawing Figures

THROTTLE BODY FUEL INJECTION

BACKGROUND AND SUMMARY OF THE INVENTION

This invention relates to fuel preparation systems for internal combustion engines and is particularly concerned with an arrangement which improves the performance of a fuel injection system at low engine speeds and light load conditions.

Fuel preparation systems for internal combustion engines such as used in automobiles require that the throttle provide control over a very substantial range of induction flows encompassing the full range of engine operating speeds and loads. In today's internal combustion automotive engines, the problem is compounded because Federal regulations mandate a minimum amount of exhaust emission pollutants and hence control of the mixture preparation is extremely important if compliance with these regulations is to be achieved. While it is important to provide accurate control over the full operating range of the engine, such control becomes particularly critical when the engine is operating at idle and low engine speeds and at light loads. This is because if the proper fuel/air mixture is not available to the cylinders of the engine under such operating conditions, the engine can stumble or even stall.

In a conventional carburetor there are typically two metering systems, namely a main metering system and an idle metering system. The main metering system usually involves a venturi located upstream of the throttle blade at which fuel is introduced into the induction air stream when the engine is operating at speeds above idle and at more than the minimum engine load.

The idle system on the other hand has an idle port located downstream of the throttle blade whereby fuel mixed with air is introduced into the induction air below the throttle blade. The idle port has an adjusting screw allowing mixture settings for best engine idle operation. There is a transfer slot in the wall of the throttle bore just upstream of the idle port which, when the throttle blade is in the idle position, serves to conduct part of the induction air around the throttle blade so that it can be inducted along with part of the idle fuel into the combustion chambers of the engine plus the adjustable idle fuel mixed with air from the idle port.

The advent of electronics in internal combustion engine controls has created the possibility of more precise control of air/fuel ratios toward the objective of minimizing exhaust pollutions. This means that electronic control of fuel injectors can provide very precise metering of fuel into the induction passage of an engine. However, the fact that the amount of fuel metered into the induction passage can be accurately controlled by the use of electronics is not in and of itself a guarantee that a suitable air/fuel mixture preparation will occur.

In the development of throttle body injection systems wherein a fuel injector is mounted on a throttle body in the vicinity of the throttle blade, a problem has been observed which may have heretofore escaped detection. Particularly, the problem is that when fuel is sprayed from the injector onto the walls of the induction bore and onto the throttle blade disposed in said bore, a mixture restriction occurs at low engine speeds and light engine loads (high vacuum conditions) which prevents the attainment of a sonic mixture velocity. This adversely affects the quality of the mixture preparation and it means that at very low idle speeds the engine may begin to run rough and even so far as to stall out even though the appropriate amount of fuel is being injected. In the carburetor, of course, this problem does not occur because of the fact that the idle port is disposed downstream of the closed throttle blade where there is a high vacuum sucking fuel in. In a throttle body type injection system the inclusion of a separate idle metering system analogous to that of the carburetor would tend to defeat the whole purpose of using electronically controlled injectors because the precise control which electronics can provide would be lost when the engine is idling or running at very light loads. However, to provide the proper restriction at low idle speeds it is necessary that the throttle blade be able to fully or almost close to its full closed position. The problem is also compounded with single bore throttle bodies because of the divergent requirements at wide open throttle (WOT) vis-a-vis idle. For minimum restriction at WOT the induction bore should have as large a diameter as possible; yet the larger the bore, the more difficult it is to achieve proper idle fuel/air mixture preparation.

The present invention arises through the recognition of the foregoing problem and provides a solution to it whereby in a throttle body fuel injection system, fuel is introduced into the induction passage by the injector exclusively upstream of the throttle blade over the full operating speed and load range of the engine including engine idle at minimum load, and aperture means are provided which are effective, with the throttle blade at and adjacent its closed position, to establish communication between points upstream and downstream of the induction passage relative to the throttle blade and are of sufficient size to conduct both the induction air and the entrained fuel as a mixture at sonic velocity past the throttle blade sufficient to keep the engine running even at low speeds and minimum load. One advantage is that low idle speeds can be obtained while still complying with pertinent regulations. This means improved fuel economy and less wear and tear on the engine.

The foregoing features, advantages and benefits of the invention, along with additional ones, will be seen in the ensuing description and claims which should be considered with the accompanying drawings.

The drawings disclose preferred embodiments of the invention in accordance with the best mode presently contemplated for carrying out the invention.

DESCRIPTION OF THE PREFERRED EMBODIMENTS

Figure 1:
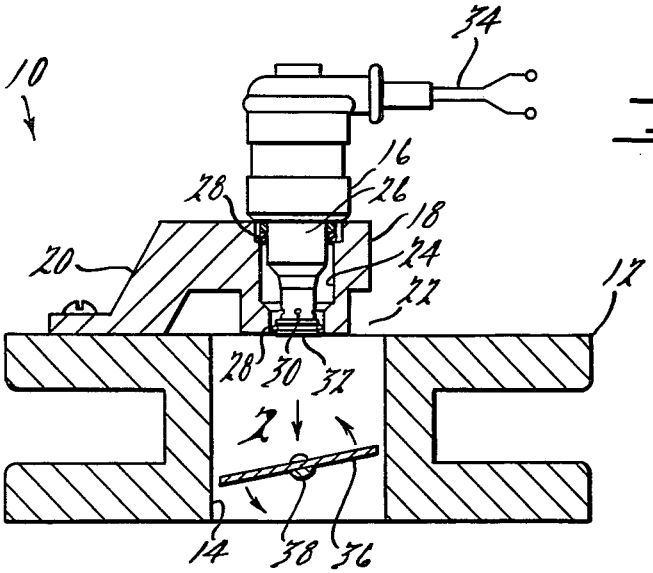
FIG. 1 is a vertical sectional view through a throttle body including a throttle body injection system embodying principles of the present invention.

In FIG. 1, a fuel injection system 10 embodying principles of the present invention is seen to comprise a throttle body 12 having a circular bore 14. A fuel injector 16 mounts on throttle body 12 by means of a support structure 18. The support structure comprises a plurality of legs 20 which extend upwardly and radially inwardly to support the injector 16 centrally above the bore. The legs define between them spaces 22 via which induction air passes into the bore 14. The central portion of the support comprises a bore 24 in which the lower end portion 26 of the injector 16 is disposed. The lower portion 26 of the injector is sealed at the top and bottom within bore 24 by means of O-ring seals 28. This defines an enclosed chamber, and fuel for the injector is supplied from a fuel pump (not shown) via a fuel circuit (not shown) to this chamber. There are one or more inlets 30 in the injector portion 26 via which fuel enters the injector. The injector tip faces downwardly into bore 14. Leads 34 are connected to an electronic control not shown. The electronic control delivers energizing pulses to the injector which cause fuel to be sprayed from tip 32 into the bore 14 for mixture with the induction air.

Figure 2:
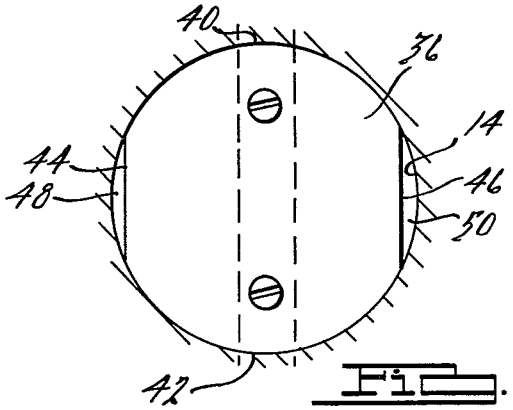
FIG. 2 is an enlarged view taken in the direction of arrow 2 of FIG. 1.

Disposed within bore 14 is a throttle blade 36 which is mounted on a shaft 38 extending transversely across the induction passage. The blade is shown in FIG. 1 in the closed position and is operable in the direction of the small arrows to increasingly open the passage. FIG. 2 illustrates in greater detail the construction of blade 36 and demonstrates the closed position. The figures may not necessarily be to scale so that the inventive principles can be visualized. The blade has, when viewed in the direction of arrow 2, a circular contoured portion 40 and a diametrically opposite circular contoured portion 42. The blade 36 is mounted on shaft 38 to be self-closing and is biased (for example, by a torsion spring, not shown) to the idle position. Per conventional carburetor design practice, the idle position is slightly cracked (typically 2°) from closed throttle to avoid blade binding. The present invention, while preferably adhering to the customary design practice, can allow the engine to idle with the blade closed. When the blade is in the closed position, sections 40 and 42 close against the circular wall of the bore 14, providing a positive stop closing. Also it is desirable to make the distance from the centerline of the shaft to the intersection of the straight and curved edges approximately one half the radius of the bore for positive stop closing of the throttle blade against the bore wall at closed throttle. Because in the closed position illustrated in FIG. 1 the blade is disposed at an angle which is inclined slightly to a plane which is perpendicular to the bore 14, the actual appearance of the blade per se in plan has the sections 40 and 42 of a slightly elliptical shape. However, as is understood in the art, this type of blade is referred to generally as a circular throttle blade or throttle disc, or a butterfly. It will be appreciated that various arrangements may be employed to establish the idle position.

Pursuant to principles of the invention, the blade is provided with sections 44 and 46 which define, in cooperation with the juxtaposed portions of the wall of bore 14, apertures 48 and 50 respectively. The apertures allow for the passage of fluid mixture comprising fuel from injector 16 entrained with the induction air at sonic velocity past the blade when the blade is at its idle position. It is believed that there is a certain critical relationship in the actual dimensions of the apertures 48 and 50, and it is believed that there should be a clearance of at least 0.010 inch from the midpoint of the edge of each section 44, 46 to the corresponding wall portion of the bore with the blade in the closed position in order to ensure a sonic mixture velocity for the two fluids. It will be observed that there is no provision for introducing fuel into the throttle body downstream of blade 36. Thus, the injector 16 provides the only source of fuel into the induction passage bore encompassing the fuel operating range of the engine including operation at idle speed and at minimum engine load. The provision of the sections 44, 46 to define the apertures 48,50 is what allows the engine to operate properly at the minimum engine demands without running rough or stalling. Furthermore, the correct fuel/air ratio is provided so that exhaust emission pollutants are kept to a minimum.

Figure 3:
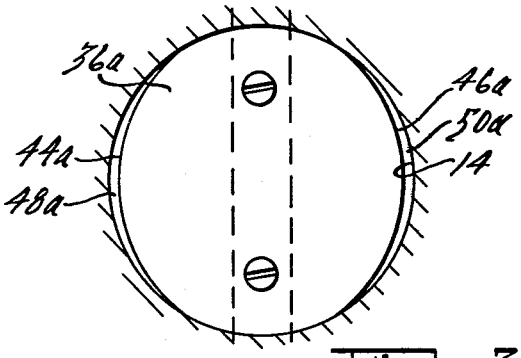
FIGS. 3, 4, 5 and 6 are views similar to the view of FIG. 2 showing further embodiments.

Pursuant to principles of the invention, other configurations of throttle blades are possible. In FIG. 3 there is illustrated a blade **36*a* having crescent shaped sections 44*a*, 46*a* which define crescent shaped apertures 48*a*, 50*a*. Preferably all the sections are circular arcs when viewed in the direction of FIG. 3. In the cresent shaped apertures, the minimum 0.10 inch dimension at the midpoints of the sections 44*a*, 46*a*** is also appropriate.

Figure 4:
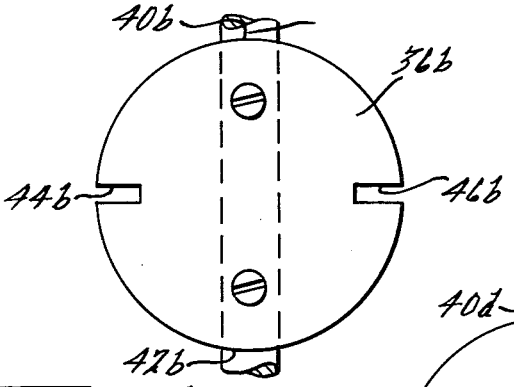

FIG. 4 illustrates another possible configuration of blade **36*b*** wherein radially extending slots are provided. These slots are dimensioned to the dimensions 0.025"×0.375".

Figure 5:
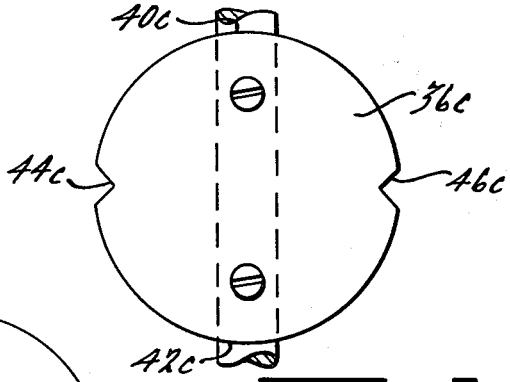

FIG. 5 illustrates another embodiment wherein the apertures are defined by small "v" shaped notches. The dimensions of the notches are 90°×0.063" radial depth to root of v.

Figure 6:
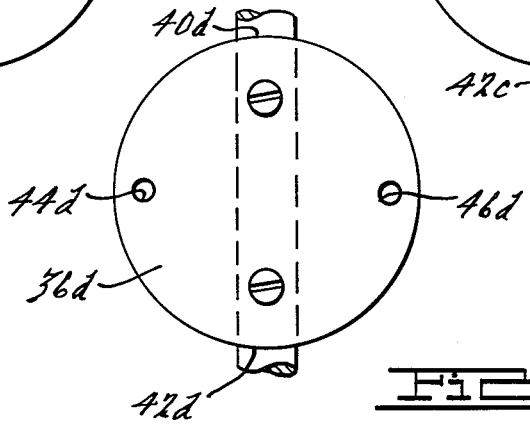

FIG. 6 illustrates still another embodiment in which the apertures do not intersect the perimeter of the disc but rather take the form of circular holes extending through the throttle blade and set radially inwardly from the perimeter of the blade. The dimensions of the holes are 0.065" diameter.

All dimensions given are for blades which fit within a 1.6875" diameter bore. The total effective cross sectional area provided by the apertures when the blade is in the closed position, is selected to develop the desired idle speed requirements. The apertures also provide sharp edges which promote shearing of fuel from the blade.

What is claimed is:

1. In a throttle body fuel injection system for an internal combustion engine having a fuel injector which sprays fuel into an induction passage for mixture with induction air passing through the passage, an idle speed system comprising: a throttle blade in the induction pasage as the sole control for air and fuel flow therethrough and pivotal between an open position which provides minimal restriction to the flow and an idle position which provides maximum restriction to the flow therethrough; the throttle blade being configured so that in an idle position a substantial portion of the circumferential edge of the blade approaches sealing contact with the wall of the induction passage to thereby block the flow of air and fuel therebetween; the remaining circumferential portion of the throttle blade being spaced just sufficiently with respect to the wall of the induction passage when the throttle blade is in its idle position to provide necessary idle air and fuel flow therebetween at sonic velocities adequate to thoroughly mix the fuel with the air as both pass between the blade and the wall of the induction passage; the slight spacing between the blade and the wall of the passage provided by a blade edge section inwardly contouring with respect to the wall of the induction passage thereby defining an aperture.

2. The throttle body fuel injection system of claim 1 with the induction passage being circular in cross section, the throttle blade having a conforming circular edge portion over a substantial portion of its circumference, a non-circular inward section being formed along the remaining circumferential edge thereby defining an aperture.

* * * * *